US009615685B2

(12) United States Patent
Fischer

(10) Patent No.: US 9,615,685 B2
(45) Date of Patent: Apr. 11, 2017

(54) APPARATUS FOR DRESSING AID

(71) Applicant: Henry F. Fischer, Reisterstown, MD (US)

(72) Inventor: Henry F. Fischer, Reisterstown, MD (US)

( * ) Notice: Subject to any disclaimer, the term of this patent is extended or adjusted under 35 U.S.C. 154(b) by 0 days.

(21) Appl. No.: 15/131,591

(22) Filed: Apr. 18, 2016

(65) Prior Publication Data

US 2016/0302601 A1 Oct. 20, 2016

Related U.S. Application Data

(60) Provisional application No. 62/149,953, filed on Apr. 20, 2015.

(51) Int. Cl.
*A47G 25/80* (2006.01)
*A47G 25/90* (2006.01)

(52) U.S. Cl.
CPC ..... *A47G 25/90* (2013.01)

(58) Field of Classification Search
CPC ..... A47G 25/80; A47G 25/82; A47G 25/90; A47G 25/905; A47G 25/907; A47G 25/908
USPC ..... 223/111, 112, 113, 114, 118, 119
See application file for complete search history.

(56) References Cited

U.S. PATENT DOCUMENTS 3,080,867 A * 3/1963 Eichinger ..... A61B 17/12009 24/115 G
4,756,453 A * 7/1988 Pettit ..... A47G 25/905 223/111
5,626,269 A * 5/1997 Duarte ..... A47G 25/905 223/112
7,988,022 B1 * 8/2011 Hansson ..... A47G 25/905 223/111
8,904,605 B2 * 12/2014 Kawaguchi ..... F16G 11/101 24/115 G
2005/0205619 A1 * 9/2005 Morel ..... A47G 25/90 223/111
2009/0039118 A1 * 2/2009 Whitlaw ..... A47G 25/90 223/111
2010/0006609 A1 * 1/2010 McAllister ..... A47G 25/908 223/111
2010/0078450 A1 * 4/2010 Longhurst ..... A47G 25/90 223/111
2011/0315724 A1 * 12/2011 Whitlaw ..... A47G 25/90 223/111

* cited by examiner

*Primary Examiner* — Nathan Durham

(57) ABSTRACT

An apparatus for dressing aid includes a first side arm, a second side arm, a stationary stabilizer bar, a removable stabilizer bar, a first and second attachment clip. The first and second side arms are oppositely positioned of each other along the stationary stabilizer bar and pivotably connected to the stationary stabilizer bar. The first and the second attachment clips are respectively connected to a distal end of the first side arm and the second side arm so that a garment can be secured to the first and second side arms. The apparatus is then utilized to put the garment, wherein the first and second side arms are individually operated about pivot connections of the stationary stabilizer bar. The first and second side arms also form a rigid structure with the removable stabilizer bar that attaches to a proximal end of the first and second side arms.

6 Claims, 8 Drawing Sheets

APPARATUS FOR DRESSING AID

The current application claims a priority to the U.S. Provisional Patent application Ser. No. 62/149,953 filed on Apr. 20, 2015.

FIELD OF THE INVENTION

The present invention relates generally to an apparatus for a dressing aid device. More specifically, the present invention helps the user to put on an upper or lower garment with increased ease and independence.

BACKGROUND OF THE INVENTION

Elderly individuals as well as other individuals who have difficulty with wearing upper and lower garments, i.e., pants, sweaters, blouses, and shirts, often utilize a dress stick or other similar items to wear the respective garments. However, the existing dress aid apparatus can be expensive and can be inefficient due to their component configuration. For example, an existing dress stick allows a user to put on an upper and lower garment, but it can only be used to put on one sleeve at a time. As a result, the user has to spent excess time to put the garment since the respective garment includes two sleeves. The existing dress aid apparatus also lack a secure attachment between the dress aid apparatus and the garment, where the user constantly losses the grip between the dress aid apparatus and the garment.

It is there for an object of the present invention to provide an efficient dress aid apparatus for those who required. The present invention replaces the antiquated tools that are utilized for the lower body dressing and upper body dressing. A pair of attachment clamps securely attaches the garment to the present invention so that the user is able to position the garment with the upper body or the lower body through a pair of side arms. Then the garment can be efficiently put on by the present invention, where the present invention increases the independency of the elderly individual and other individuals who have difficulty with wearing upper and lower garments.

DETAIL DESCRIPTIONS OF THE INVENTION

All illustrations of the drawings are for the purpose of describing selected versions of the present invention and are not intended to limit the scope of the present invention.

Figure 1:
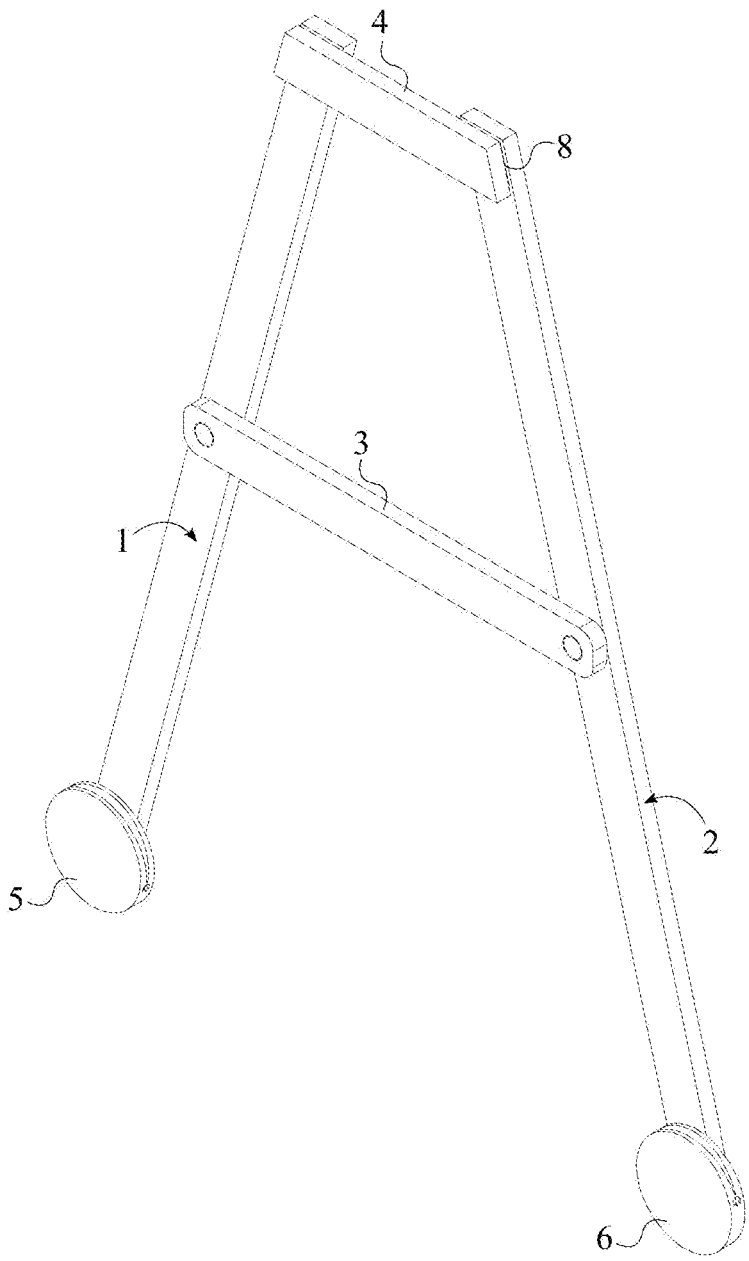
FIG. 1 is a perspective view of the present invention.

The present invention is an apparatus for dressing aid that provides assistance to elderly individuals and other individuals with physical limitations. The present invention guides and helps an individual to put on an upper or lower garment, where the present invention simplify and ease the dressing process. In reference to FIG. 1, the present invention comprises a first side arm 1, a second side arm 2, a stationary stabilizer bar 3, a removable stabilizer bar 4, a first attachment clip 5, and a second attachment clip 6.

In reference to the method of usage of the present invention, the user first needs to attach an upper or lower garment to the present invention with the first attachment clip 5 and the second attachment clip 6. The user can then grip the present invention with the first side arm 1 and the second side arm 2 or the removable stabilizer bar 4, that are positioned opposite of the first attachment clip 5 and the second attachment clip 6. For example, the first side arm 1 and the second side arm 2 are often utilized to put on a lower garment without the removable stabilizer bar 4. However, the removable stabilizer bar 4 is often utilized to put on an upper garment. In other words, the present invention functions as a body extension so that the user with physical limitations is able to put on an upper or lower garment by themselves, without requiring any outside assistance. More specifically, the present invention assists the user to align the user's feet with a waist opening of a lower garment or align user's head with a head opening of an upper garment so that the user is able to easily put on the respective garment.

Figure 6:
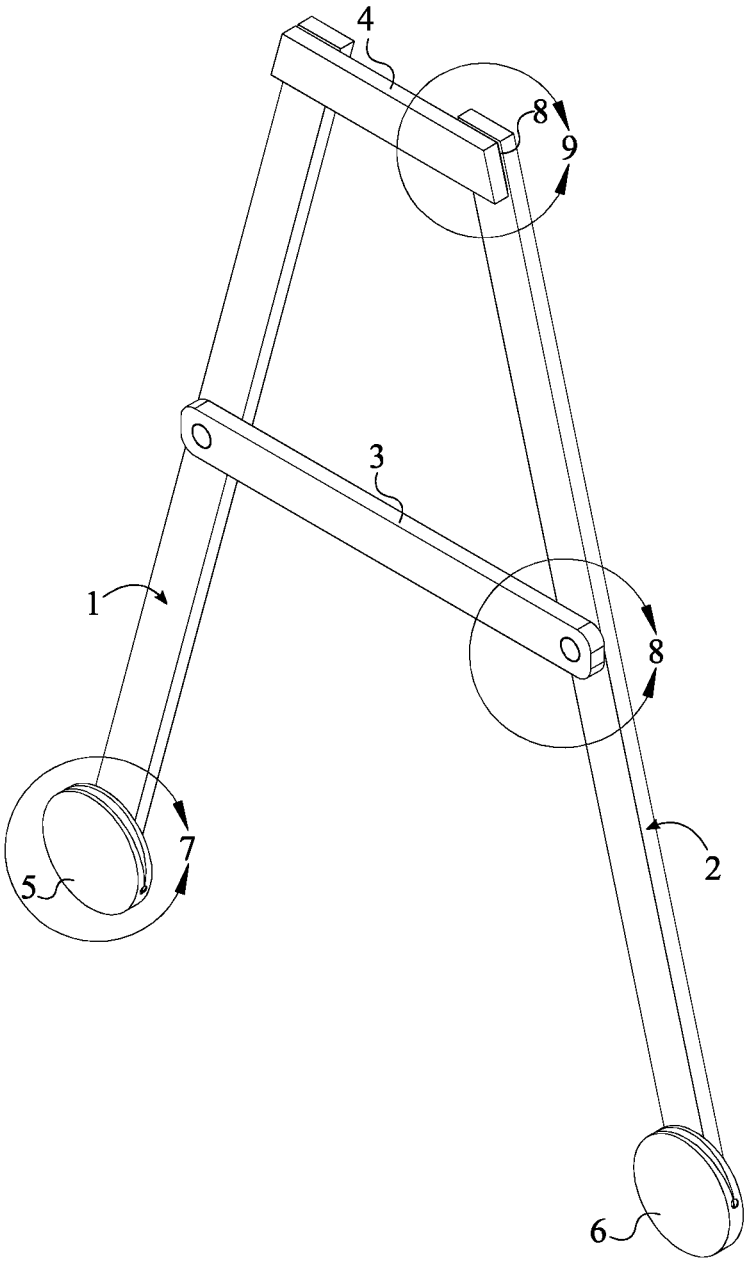
FIG. 6 is a perspective view of the present invention showing three detail view sections.
Figure 8:
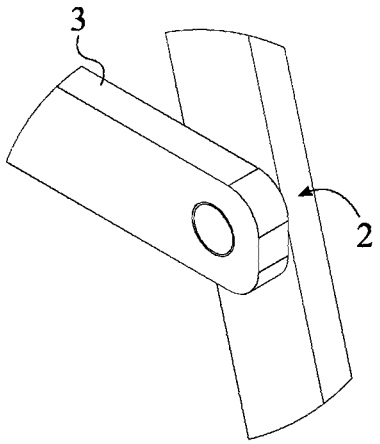
FIG. 8 is a detail view of the pivot connection between the second side arm and the stationary stabilizer bar.

The first side arm 1, the second side arm 2, and the stationary stabilizer bar 3 are preferably made of a strong and lightweight plastic or metal. The first side arm 1, the second side arm 2, and the stationary stabilizer bar 3 may also be covered with a durable nylon or other similar type material to increase the structural integrity and the esthetic appearance. In reference to FIG. 1, the first side arm 1 and the second side arm 2 are oppositely positioned of each other along the stationary stabilizer bar 3. Additionally, the stationary stabilizer bar 3 is pivotably connected to the first side arm 1 and the second side arm 2 as shown in FIG. 6 and FIG. 8. The first side arm 1 and the second side arm 2 function as arm-extensions for the user of the present invention so that the user can easily operate the present invention. More specifically, during the operation of the present invention, the user holds the first side arm 1 with their right hand and the second side arm 2 with the left hard or vice versa.

Figure 2:
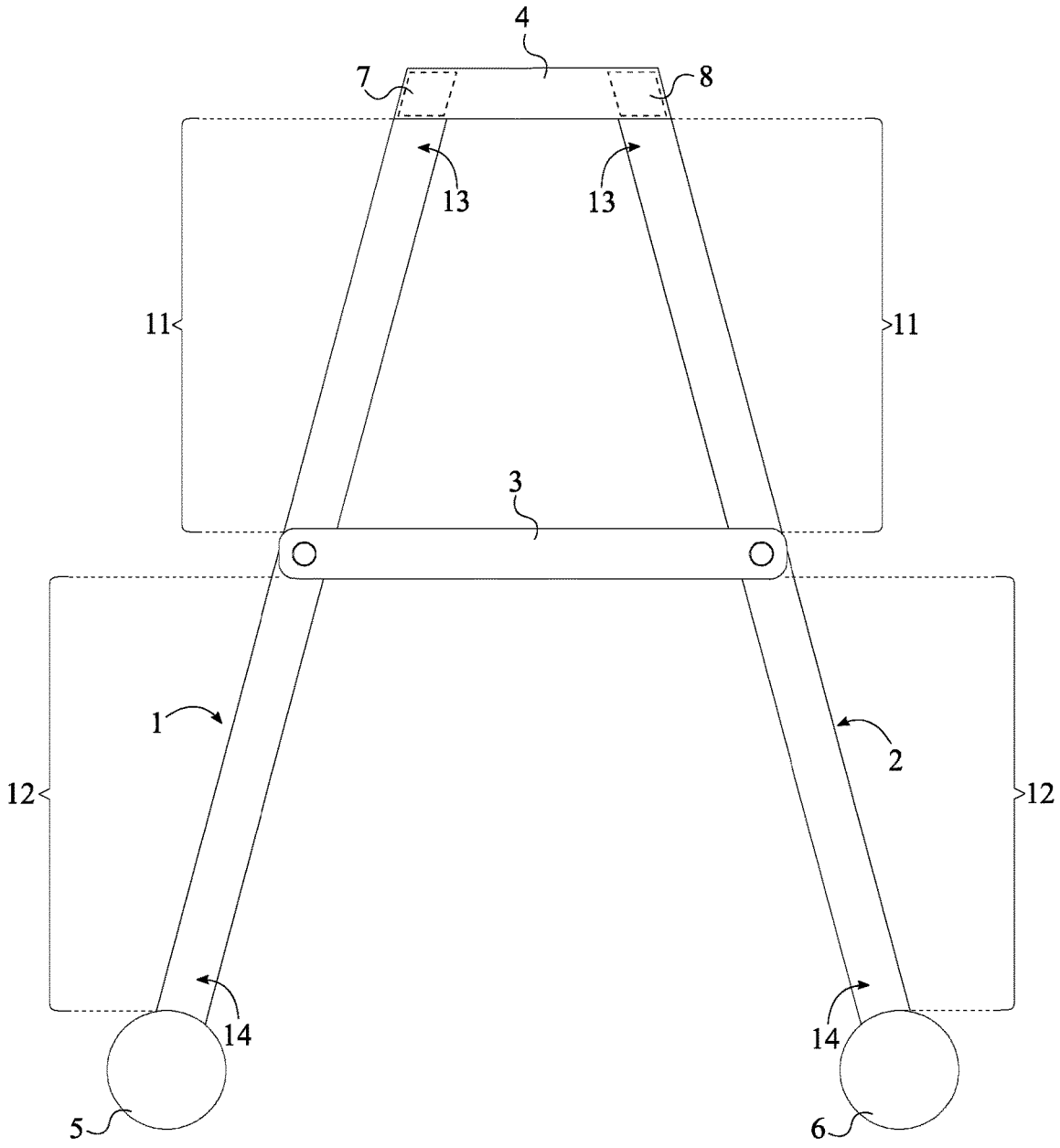
FIG. 2 is a front view of the present invention.
Figure 7:
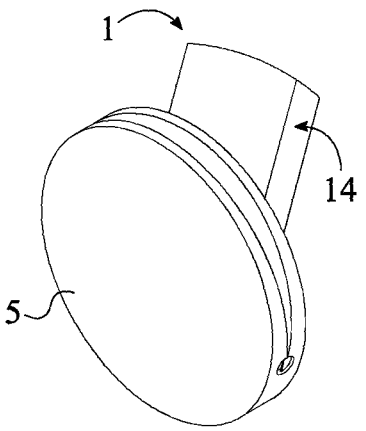
FIG. 7 is a detail view of the first attachment clip of the present invention.

The first attachment clip 5 and the second attachment clip 6 secure an upper or lower garment to the present invention and preferably made of a lightweight and strong material, such as hard plastic or aluminum. The first attachment clip 5 and the second attachment clip 6 are also completely covered with a soft-grip rubber. The soft-grip rubber protects the upper or lower garment from any kind of damages that may occurs from the first attachment clip 5 or the second attachment clip 6. Additionally, the soft-grip rubber allows the user to securely press down on the first attachment clip 5 and the second attachment clip 6, thus allowing the user to easily handle and maneuver the first attachment clip 5 and the second attachment clip 6 during the operation of the present invention. In reference to FIG. 2, FIG. 6 and FIG. 7, the first attachment clip 5 is connected to a distal end 14 of the first side arm 1, and the second attachment clip 6 is connected to a distal end 14 of the second side arm 2.

Figure 5:
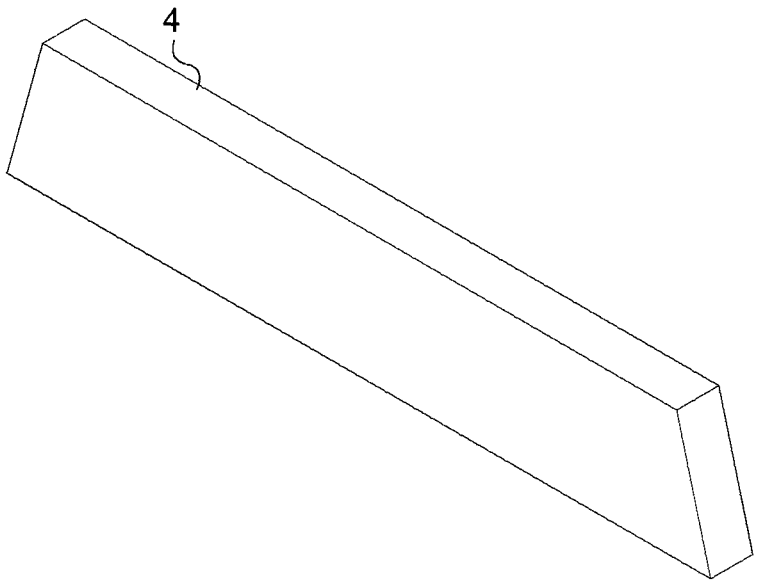
FIG. 5 is a perspective view of the removable stabilizer bar of the present invention.
Figure 9:
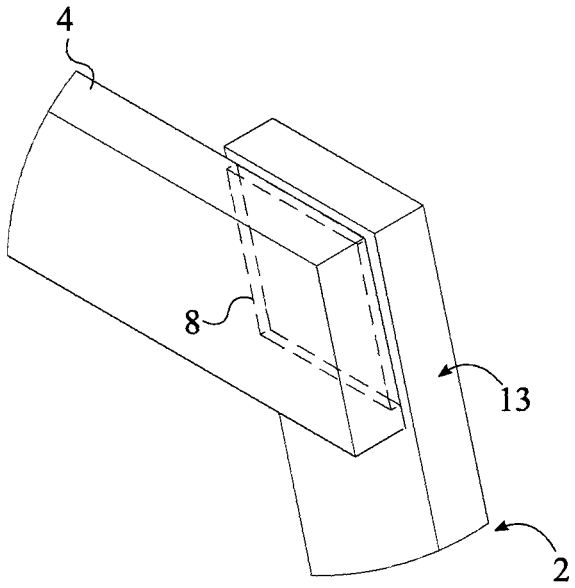
FIG. 9 is a detail view of the second attachment mechanism between the second side arm and the removable stabilizer bar.
Figure 10:
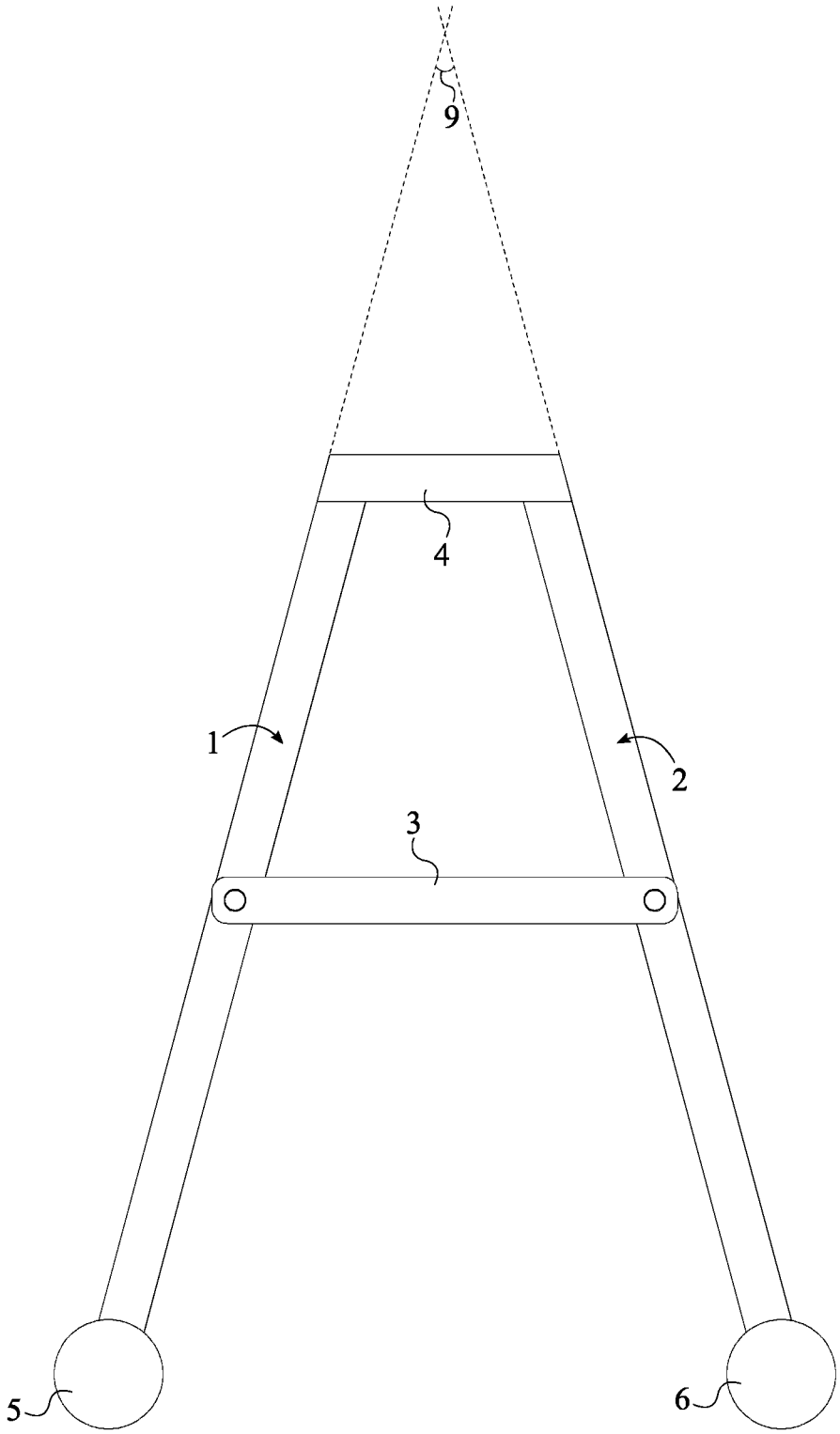
FIG. 10 is a front view of the present invention showing the acute angle between the first side arm and the second side arm.

The removable stabilizer bar 4 transforms the present invention in to a rigid structure, wherein the first side arm 1 and the second side arm 2 are unable to move about the pivot connections of the stationary stabilizer bar 3. Similar to the stationary stabilizer bar 3, the removable stabilizer bar 4 is made of a strong and lightweight plastic or metal while the removable stabilizer bar 4 is also covered with a durable nylon or other similar type material to increase the structural integrity and the esthetic appearance. In reference to FIG. 2 and FIG. 5, the removable stabilizer bar 4 is attached to a proximal end 13 of the first side arm 1 and the second side arm 2. The removable stabilizer bar 4 is also positioned parallel with the stationary stabilizer bar 3. More specifically, the proximal end 13 of the first side arm 1 is engaged with the removable stabilizer bar 4 by a first fastening mechanism 7. Similarly, the proximal end 13 of the second side arm 2 is engaged with the removable stabilizer bar 4 by a second fastening mechanism 8. In reference to FIG. 10, the first side arm 1 and the second side arm 2 are also oriented in an acute angle 9 as a length of the removable stabilizer bar 4 is smaller than a length of the stationary stabilizer bar 3. The acute angle 9 allows the user to maintain a comfortable and small movement range adjacent to the proximal end 13 of the first side arm 1 and the proximal end 13 of the second side arm 2 while allowing a wider movement range adjacent to the first attachment clip 5 and the second attachment clip 6. In reference to FIG. 6 and FIG. 9, the first fastening mechanism 7 and the second fastening mechanism 8 are preferably a hook-and-loop fastener within the present invention. More specifically, an outer edge of the first side arm 1 and the second side arm 2 are attached to a pair of outer edges of the removable stabilizer bar 4 through hook-and-loop fasteners. For example, a first hook-and-loop fastener is sandwiched between the outer edge of the first side arm 1 and the outer edge of the removable stabilizer bar 4. Similarly, a second hook-and-loop fastener is sandwiched between the outer edge of the second side arm 2 and the outer edge of the removable stabilizer bar 4, opposite of the first side arm 1. Alternatively, an outer surface of the first side arm 1 and the second side arm 2 can externally attach to an outer surface of the removable stabilizer bar 4 through the hook-and-loop fastener. However, present invention can utilize any other types of simple fasteners, such as button fasteners, nut-and-bolt fasteners, snap fasteners and pressure fit fasteners, as the first fastening mechanism 7 and the second fastening mechanism 8.

Figure 3:
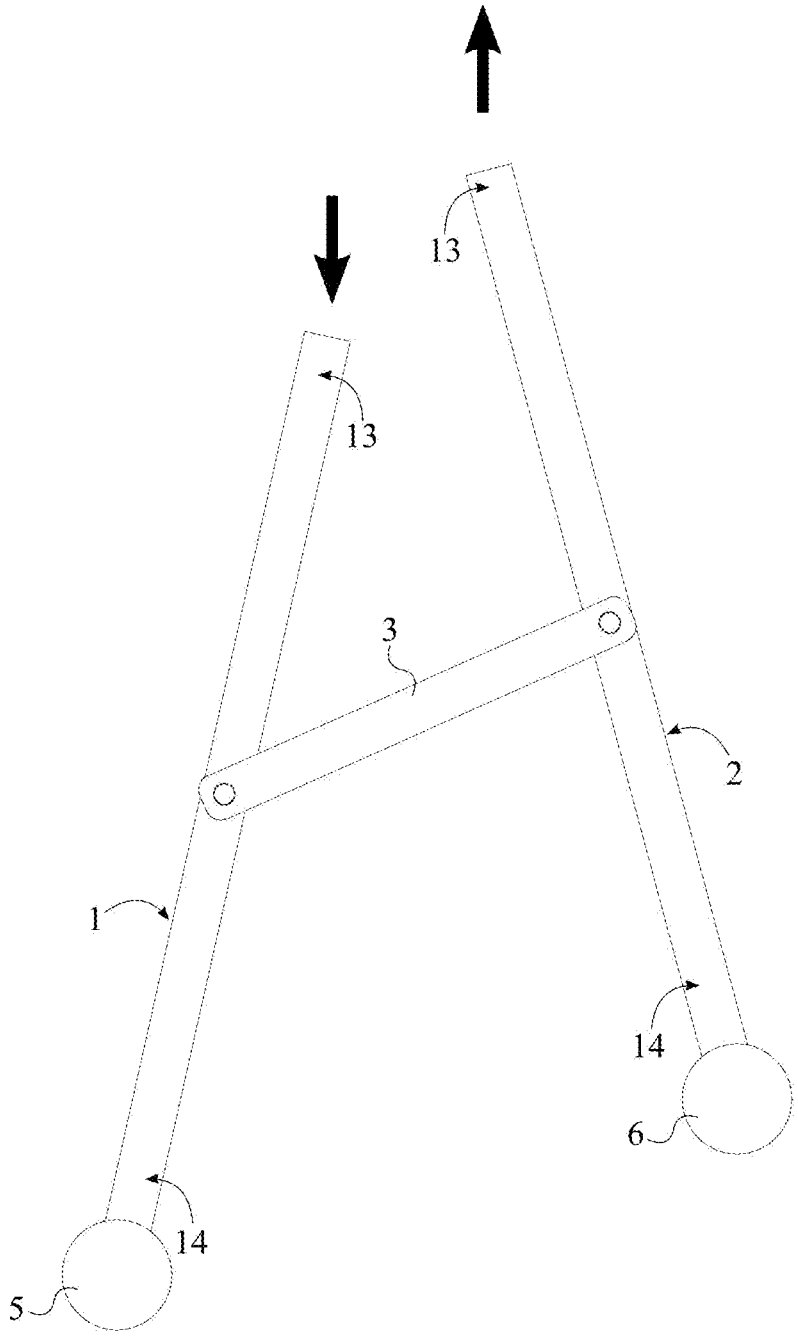
FIG. 3 is a front view of the present invention showing the individual movement of the first side arm and the second side arm.
Figure 4:
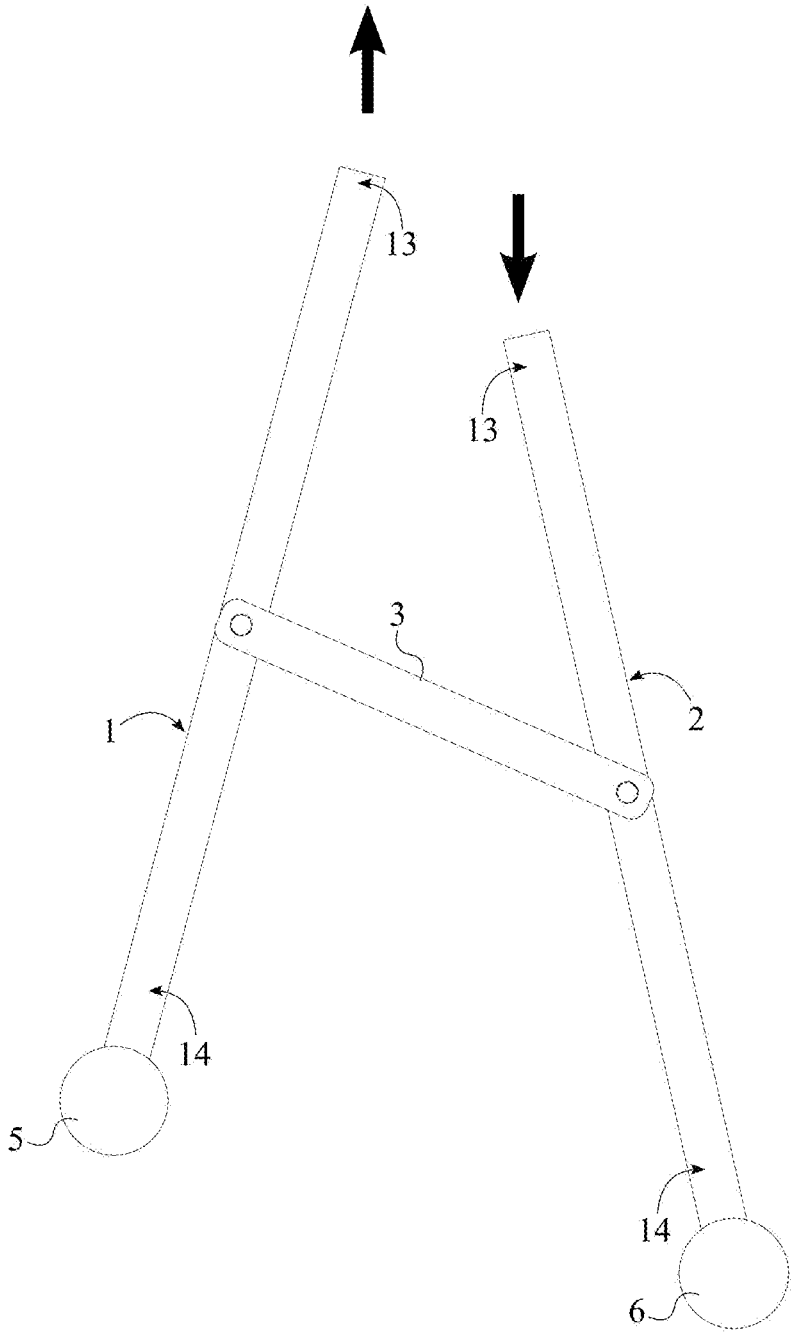
FIG. 4 is another front view of the present invention showing the individual movement of the first side arm and the second side arm.

When the user is required to lock the first side arm 1 and the second side arm 2 in place, the removable stabilizer bar 4 is able to achieve this configuration as the first side arm 1 and the second side arm 2 are unable to move about the pivot connections of the stationary stabilizer bar 3. However, when the user is required to individually control the first side arm 1 and the second side arm 2, the removable stabilizer bar 4 is detached from the first side arm 1 and the second side arm 2. As a result, the user can independently control the first side arm 1 and the second side arm 2 about the pivot connections of the stationary stabilizer bar 3. Independent control of the first side arm 1 and the second side arm 2 are shown in FIG. 3 and FIG. 4.

The first side arm 1 and the second side arm 2 each comprise a hand-placement section 11 and an extended section 12. In reference to FIG. 1, the hand-placement section 11 and the extended section 12 are adjacently positioned of each other along the first side arm 1 and the second side arm 2. The hand-placement section 11 provides the necessary surface area for the user to hold on to the present invention. the extended section 12 provides the usable length that the present invention can operate between the user and an upper or lower garment. More specifically, the hand-placement section 11 of the first side arm 1 and the second side arm 2 position in between the removable stabilizer bar 4 and the stationary stabilizer bar 3 so that the user can easily hold onto the first side arm 1 and the second side arm 2. The extended section 12 of the first side arm 1 is positioned in between the stationary stabilizer bar 3 and the first attachment clip 5. Similarly, the extended section 12 of the second side arm 2 is positioned in between the stationary stabilizer bar 3 and the second attachment clip 6.

Although the invention has been explained in relation to its preferred embodiment, it is to be understood that many other possible modifications and variations can be made without departing from the spirit and scope of the invention as hereinafter claimed.

What is claimed is:

1. An apparatus for dressing aid comprises:
- a first side arm;
- a second side arm, wherein both the first side arm and the second side arm are rigid;
- a stationary stabilizer bar;
- a removable stabilizer bar;
- a first attachment clip;
- a second attachment clip;
- a first fastening mechanism;
- a second fastening mechanism;
- the first side arm and the second side arm being oppositely positioned of each other along the stationary stabilizer bar;
- the first attachment clip being connected to a distal end of the first side arm;
- the second attachment clip being connected to a distal end of the second side arm;
- a proximal end of the first side arm being engaged to the removable stabilizer bar by the first fastening mechanism;
- a proximal end of the second side arm being engaged to the removable stabilizer bar by the second fastening mechanism;
- the stationary stabilizer bar being pivotably connected to both the first side arm and the second side arm at an approximate center between the proximal end and the distal end of each respective side arm; and
- the removable stabilizer bar is positioned parallel with the stationary stabilizer bar.

2. The apparatus for dressing aid as claimed in claim 1 comprises:
- the first side arm and the second side arm each comprise a hand-placement section and an extended section;
- the hand-placement section and the extended section being adjacently positioned of each other;
- the hand-placement section being positioned in between the removable stabilizer bar and the stationary stabilizer bar;
- the extended section of the first side arm being positioned in between the stationary stabilizer bar and the first attachment clip; and
- the extended section of the second side arm being positioned in between the stationary stabilizer bar and the second attachment clip.

3. The apparatus for dressing aid as claimed in claim 1, wherein the first side arm and the second side arm are oriented in an acute angle.

4. An apparatus for dressing aid comprises:
- a first side arm;

a second side arm, wherein both the first side arm and the second side arm are rigid;

a stationary stabilizer bar;

a removable stabilizer bar;

a first attachment clip;

a second attachment clip;

a first fastening mechanism;

a second fastening mechanism;

the first side arm and the second side arm being oppositely positioned of each other along the stationary stabilizer bar;

the first attachment clip being connected to a distal end of the first side arm;

the second attachment clip being connected to a distal end of the second side arm;

a proximal end of the first side arm being engaged to the removable stabilizer bar by the first fastening mechanism;

a proximal end of the second side arm being engaged to the removable stabilizer bar by the second fastening mechanism;

the stationary stabilizer bar being pivotably connected to both the first side arm and the second side arm at an approximate center between the proximal end and the distal end of each respective side arm; and the first side arm and the second side arm being oriented in an acute angle.

5. The apparatus for dressing aid as claimed in claim 4 comprises:

the first side arm and the second side arm each comprise a hand-placement section and an extended section;

the hand-placement section and the extended section being adjacently positioned of each other;

the hand-placement section being positioned in between the removable stabilizer bar and the stationary stabilizer bar;

the extended section of the first side arm being positioned in between the stationary stabilizer bar and the first attachment clip; and the extended section of the second side arm being positioned in between the stationary stabilizer bar and the second attachment clip.

6. The apparatus for dressing aid as claimed in claim 4, wherein the removable stabilizer bar is positioned parallel with the stationary stabilizer bar.

* * * * *